US008443884B2

(12) United States Patent
Crawford

(10) Patent No.: US 8,443,884 B2
(45) Date of Patent: May 21, 2013

(54) DIRECTIONAL SETTING TOOL AND ASSOCIATED METHODS

(75) Inventor: Don Leon Crawford, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 293 days.

(21) Appl. No.: 12/871,967

(22) Filed: Aug. 31, 2010

(65) Prior Publication Data

US 2011/0061865 A1 Mar. 17, 2011

(30) Foreign Application Priority Data

Sep. 15, 2009 (WO) ..... PCT/US2009/056945

(51) Int. Cl.
*E21B 47/00* (2012.01)
*E21B 23/03* (2006.01)

(52) U.S. Cl.
USPC ..... 166/255.2; 166/382; 166/117.6

(58) Field of Classification Search
USPC ..... 166/382, 255.2, 117.6
See application file for complete search history.

(56) References Cited

U.S. PATENT DOCUMENTS 5,379,845 A 1/1995 Blount et al.
5,740,864 A 4/1998 de Hoedt et al.
5,947,201 A 9/1999 Ross et al.
6,109,347 A 8/2000 Ferguson et al.
2003/0010533 A1 1/2003 Hart et al.
2005/0241825 A1 11/2005 Burris, II et al.
2007/0240903 A1 * 10/2007 Alft et al. ..... 175/50
2009/0168606 A1 * 7/2009 Lerche et al. ..... 367/197

OTHER PUBLICATIONS

Analong Devices, "Small, Low Power, 3-Axis +3 g iMEMS Accelerometer," ADXL330, dated 2007, 16 pages.
Freescale Semiconductor, Technical Data MMA7260QT, dated Mar. 2008, 12 pages.
Halliburton, "Downhole Power Unit (DPU)—Intelligent Series Tool", H06387, dated Jan. 2009, 2 pages.
Dirk Alexander Andel and Patrick Ian Tawse, "Multilateral Technology, States-of-the-art Downhole Milling Equipment, and Underbalanced Perforating Techniques Combine to Meet Challenges to Maximize Last Slot on Subsea Template", SPE 63267, dated Oct. 1-4, 2000, 14 pages.
Robert H. Joyce, "Electric Wireline Milling—New Solutions for New Challenge", SPE/IADC 119382, Mar. 17-19, 2009, 9 pages, Amsterdam, The Netherlands.
Office Action issued Mar. 6, 2012 for Canadian Patent Application 2,714,801, 2 pages.

* cited by examiner

*Primary Examiner* — William P Neuder
(74) *Attorney, Agent, or Firm* — Smith IP Services, P.C.

(57) ABSTRACT

A setting tool for setting a well tool in a wellbore includes a setting mechanism which is operative to apply a setting force to set the well tool, and an orientation indicator which indicates an orientation of the setting tool. A method of setting a well tool and engaging an assembly with the well tool includes setting the well tool in a wellbore utilizing a setting tool which includes an orientation indicator, and then engaging the assembly with the well tool, thereby fixing an orientation of the assembly relative to the well tool. A method of azimuthally orienting a whipstock in a wellbore includes setting an anchor in the wellbore, the anchor including an alignment device, and indicating an azimuthal orientation of the alignment device relative to the wellbore. The anchor setting and azimuthal orientation indicating are performed using only a single trip into the wellbore.

19 Claims, 4 Drawing Sheets

DIRECTIONAL SETTING TOOL AND ASSOCIATED METHODS

CROSS-REFERENCE TO RELATED APPLICATIONS

This application claims the benefit under 35 USC §119 of the filing date of International Application Serial No. PCT/US09/56945, filed Sep. 15, 2009. The entire disclosure of this prior application is incorporated herein by this reference.

BACKGROUND

The present disclosure relates generally to equipment utilized and operations performed in conjunction with subterranean wells and, in an embodiment described herein, more particularly provides a directional setting tool and associated methods.

In the past, several trips into a wellbore have been required to enable an assembly (such as a whipstock and its associated equipment, etc.) to be appropriately oriented relative to the wellbore. For example, one trip may be required to set a whipstock packer or plug, another trip may be required to detect the orientation of the packer or plug relative to the wellbore, and then yet another trip may be required to run the whipstock into position in the wellbore.

It will be appreciated that improvements are needed in the art of constructing setting tools and orienting well tools relative to wellbores. These improvements would be useful for achieving appropriate orientation of whipstocks and other assemblies.

SUMMARY

In carrying out the principles of the present disclosure, a setting tool and associated methods are provided which brings improvements to the art of setting well tools in wellbores. One example is described below in which an anchor is set using a setting tool which includes an orientation indicator. Another example is described below in which a three-axis accelerometer is used to provide indications of orientation of a well tool set in a wellbore.

In one aspect, a setting tool for setting a well tool in a wellbore is provided. The setting tool includes a setting mechanism which is operative to apply a setting force to set the well tool, and an orientation indicator which indicates an orientation of the setting tool.

In another aspect, a method of setting a well tool and engaging an assembly with the well tool is provided. The method includes setting the well tool in a wellbore utilizing a setting tool which includes an orientation indicator, and then engaging the assembly with the well tool, thereby fixing an orientation of the assembly relative to the well tool.

In yet another aspect, a method of azimuthally orienting a whipstock in a wellbore includes setting an anchor in the wellbore, the anchor including an alignment device; indicating an azimuthal orientation of the alignment device relative to the wellbore; and the anchor setting and azimuthal orientation indicating being performed using only a single trip into the wellbore.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
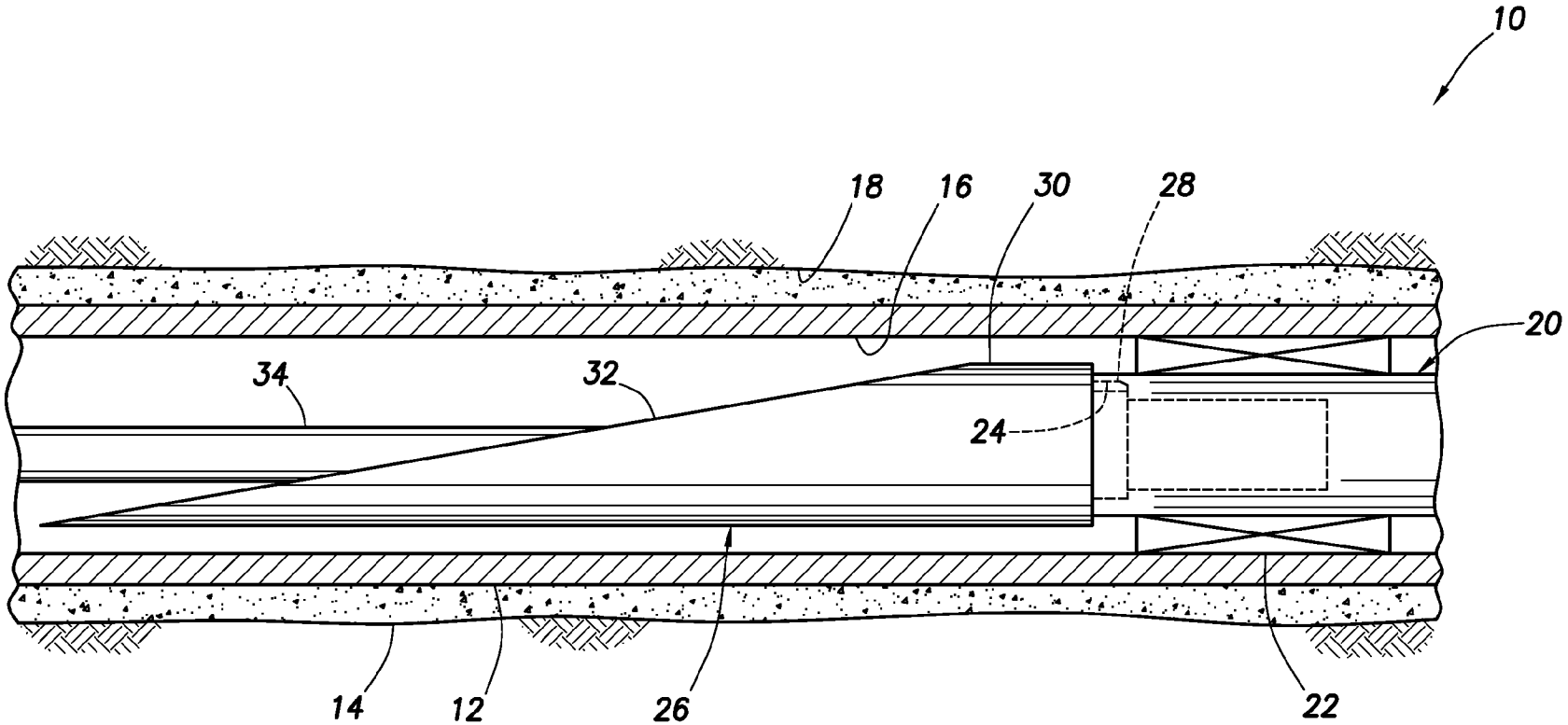
FIG. 1 is a schematic partially cross-sectional view of a system and associated method embodying principles of the present disclosure.

Representatively illustrated in FIG. 1 is a well system 10 and associated method which embody principles of the present disclosure. In the system 10, it is desired to cut a window through casing 12 which, along with cement 14, forms a protective lining for a wellbore 16.

In other examples, the wellbore 16 could be uncased or open hole, at least in the area depicted in FIG. 1, in which case the casing 12 and cement 14 would not be present. Although the wellbore 16 is indicated in FIG. 1 as corresponding to the interior of the casing 12, if the wellbore is uncased or open hole, then the wellbore would correspond to the interior of a borehole 18 drilled into the earth.

A well tool 20 is set in the wellbore 16 to provide a rigid base for milling operations used to cut the window through the casing 12. If the wellbore 16 is uncased, then the well tool 20 can still provide a rigid base for sidetracking (drilling a wellbore which deviates from the path of the wellbore 16).

The well tool 20 preferably includes an anchor 22 (such as a plug or a packer) which, when set in the wellbore 16, rigidly secures the well tool relative to the wellbore. Plugs and packers typically include elements known as slips for this purpose. However, it should be understood that other types of well tools may be set by utilizing the principles of this disclosure, and it is not necessary for the well tools to include an anchor or slips.

The anchor 22 includes an alignment device 24 (such as a keyway, J-slot, recess, etc.). The alignment device 24 is used to azimuthally orient an assembly 26 relative to the wellbore 16. The assembly 26 includes another alignment device 28 (such as a key, lug, dog, etc.) which is shaped to engage with the other alignment device 24.

The assembly 26 is preferably conveyed into the wellbore 16 after the well tool 20 has been set. In one important feature of the method, the well tool 20 can be set in the wellbore 16, and an indication of the azimuthal orientation of the well tool (and its alignment device 24) relative to the wellbore can be provided using only a single trip into the wellbore.

Once the well tool 20 has been set in the wellbore 16, and the azimuthal orientation of the well tool and its alignment device 24 are known, the azimuthal orientation of the alignment device 28 on the assembly 26 can be adjusted as desired so that, when the alignment devices 24, 28 are engaged with each other, the assembly will be azimuthally oriented as desired relative to the wellbore 16.

In the example depicted in FIG. 1, the assembly 26 includes a whipstock 30 having a deflection face 32 formed thereon for deflecting mills, drill bits, or other cutting tools laterally relative to the wellbore 16 to cut the window through the casing 12, drill a lateral wellbore, etc. Separate whipstocks or other deflectors may be used for separate operations, for example, one whipstock may be used for milling through the casing 12, and another deflector may be used for deflecting drill bits to drill a lateral wellbore, etc.

It is desired in the example of FIG. 1 to drill a lateral wellbore upward relative to the wellbore 16, and so, when a running tool 34 conveys the assembly 26 into engagement with the well tool 20, the deflection face 32 will be oriented facing upward upon engagement of the alignment devices 24, 28. If the orientation of the alignment device 24 is known upon setting the well tool 20, then the alignment device 28 of the assembly 26 can be appropriately oriented (prior to conveying the assembly into the wellbore 16), so that the deflection face 32 faces upward after engagement of the assembly with the well tool.

Of course, it is not necessary for the deflection face 32 to face upward, or for either of the alignment devices 24, 28 to be oriented upward, in keeping with the principles of this disclosure. Any of the elements described herein can be oriented in any direction, without departing from the principles of this disclosure. Furthermore, the wellbore 16 could be vertical, horizontal, inclined or in any other orientation in various other examples.

Figure 2:
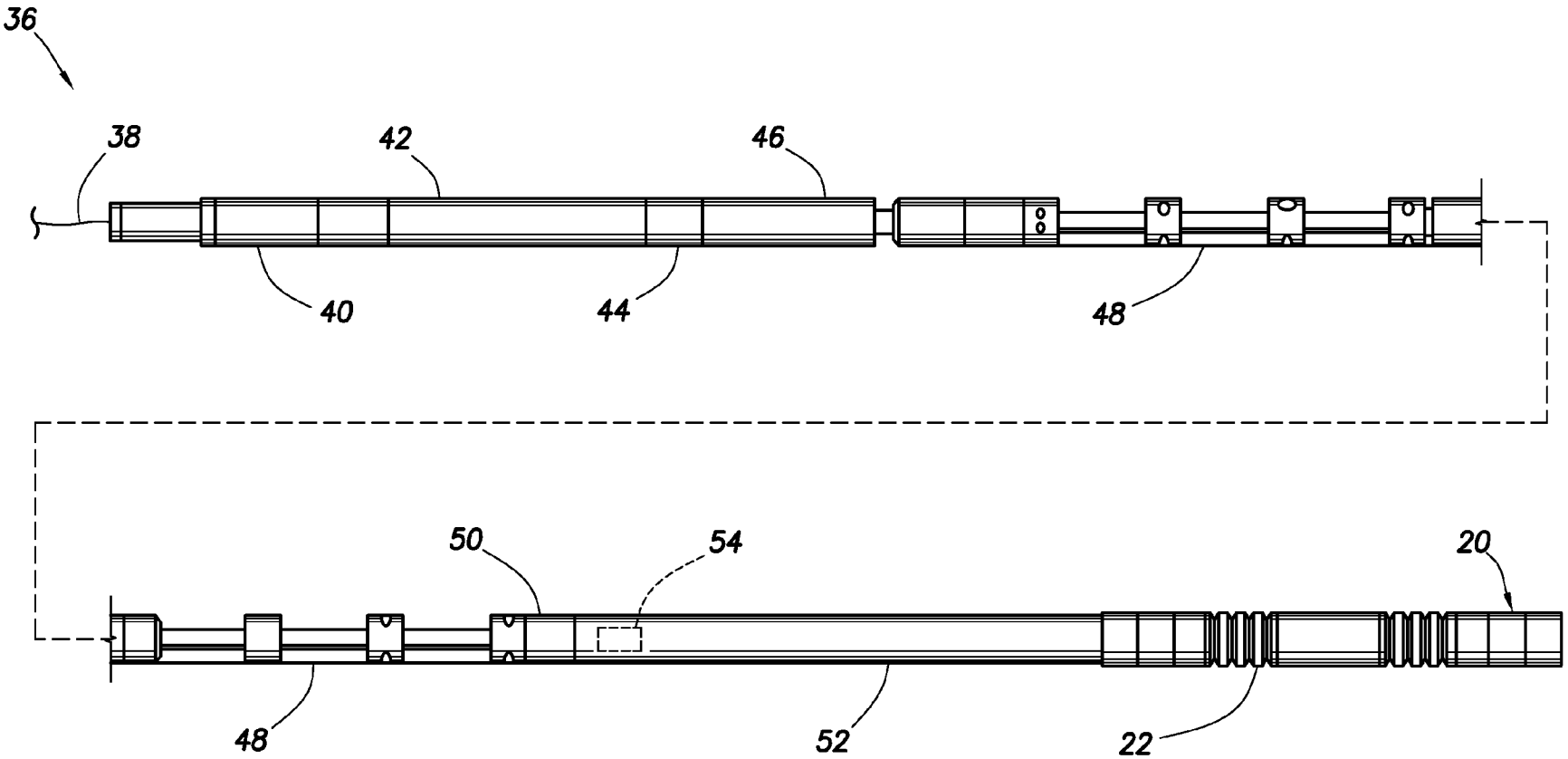
FIG. 2 is a schematic side view of a tool string which may be used in the system and method of FIG. 1.

Referring additionally now to FIG. 2, an example is representatively illustrated of a tool string 36 used to run the well tool 20 into the wellbore 16, set the well tool and provide an indication of the orientation of the well tool relative to the wellbore. A conveyance 38 (such as a wireline, slickline, coiled tubing, tractor, etc.) is used for conveying the tool string 36 to the desired position in the wellbore 16, and may in some examples also provide power for operation of the tool string, and a communication link for transmitting data, signals and/or commands between the tool string and a remote location (such as the earth's surface).

As depicted in FIG. 2, this example of the tool string 36 includes a rope socket 40, a cable head 42, a crossover 44, a swivel 46, laterally offset weight bars 48, a top sub 50, a setting tool 52, and the well tool 20 (including the anchor 22). The weight bars 48 preferentially align the well tool 20 relative to a low side of the wellbore 16, since they are laterally offset, and the swivel 46 allows the portion of the tool string 36 below the swivel to rotate as needed, so that the weight bars can settle to the low side of the wellbore.

However, it should be understood that use of the swivel 46 and weight bars 48 is not necessary in keeping with the principles of this disclosure. The well tool 20 could instead be set in any azimuthal orientation relative to the wellbore 16. The swivel 46 and weight bars 48 may be used for those circumstances where it is desired to set the well tool 20 in a particular orientation relative to the wellbore 16.

The setting tool 52 is used to apply a setting force to the well tool 20, in order to set the well tool in the wellbore 16. If the anchor 22 is a conventional whipstock packer or plug, then the setting tool 52 would apply a longitudinal pulling force to the anchor to set it. A suitable setting tool for this purpose is the DPU-i™ supplied by Halliburton Energy Services, Inc. of Houston, Tex. USA.

However, in this example, the setting tool 52 includes an additional feature in the form of an orientation indicator 54. The orientation indicator 54 preferably includes at least one accelerometer, and may include a three-axis accelerometer for indicating the orientation of the setting tool 52 in three-dimensional space.

In this manner, at least the azimuthal orientation of the well tool 20 relative to the wellbore 16 may be indicated at any time. Preferably, the orientation indicator 54 provides an indication of the orientation of the well tool 20 at least after the well tool has been set in the wellbore 16. Most preferably, the orientation indicator 54 provides an indication of the orientation of the well tool 20 before, during and after setting of the well tool.

Indications of the orientation of the well tool 20 may be provided in real time from the orientation indicator 54 to a remote location (such as the earth's surface) via the communication link provided by the conveyance 38. Alternatively, the indications could be stored in memory in the setting tool 52, for retrieval and reading at a later time (such as, when the setting tool is retrieved to the surface after setting the well tool 20).

Figure 3:
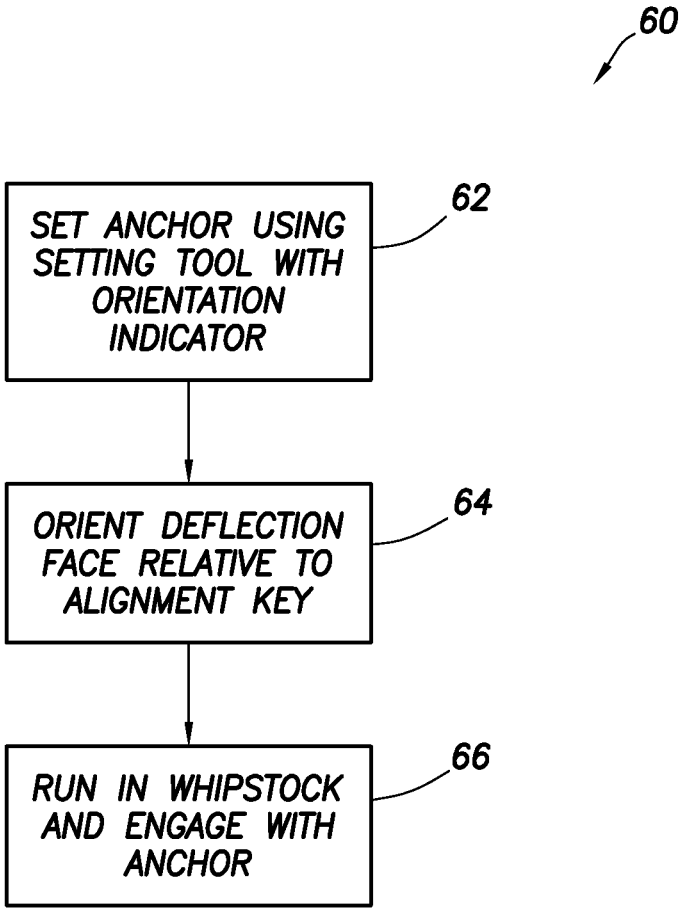
FIG. 3 is a flowchart for a method embodying principles of this disclosure.

Referring additionally now to FIG. 3, a method 60 which embodies principles of this disclosure is representatively illustrated in flowchart form. The method 60 as depicted in FIG. 3 is for azimuthally orienting the whipstock 30 in the wellbore 16, but methods may be used for orienting other equipment in a wellbore, in keeping with the principles of this disclosure.

In an initial step 62, the anchor 22 is set in the wellbore 16 using the setting tool 52 which includes the orientation indicator 54. In this manner, the azimuthal orientation of the anchor 22 and its alignment device 24 relative to the wellbore 16 can be known prior to running the whipstock 30 into the wellbore. It is an advantage of the method 60 that both purposes (setting the anchor 22 and providing an indication of the azimuthal orientation of the anchor relative to the wellbore 16) can be accomplished in only a single trip into the wellbore.

In a subsequent step 64, the deflection face 32 on the whipstock 30 is oriented relative to the alignment device 28 (which may comprise an alignment key or another type of alignment device). Since the orientation of the alignment device 24 of the anchor 22 is known at this point, it is a simple matter to orient the alignment device 28 on the whipstock 30 as needed, so that the deflection face 32 will be azimuthally oriented relative to the wellbore 16 as desired, when the alignment devices are engaged with each other downhole.

In a subsequent step 66, the whipstock 30 is run into the wellbore 16 and engaged with the anchor 22. The alignment devices 24, 28 are thereby engaged with each other, resulting in proper azimuthal orientation of the deflection face 32 relative to the wellbore 16.

Figure 4:
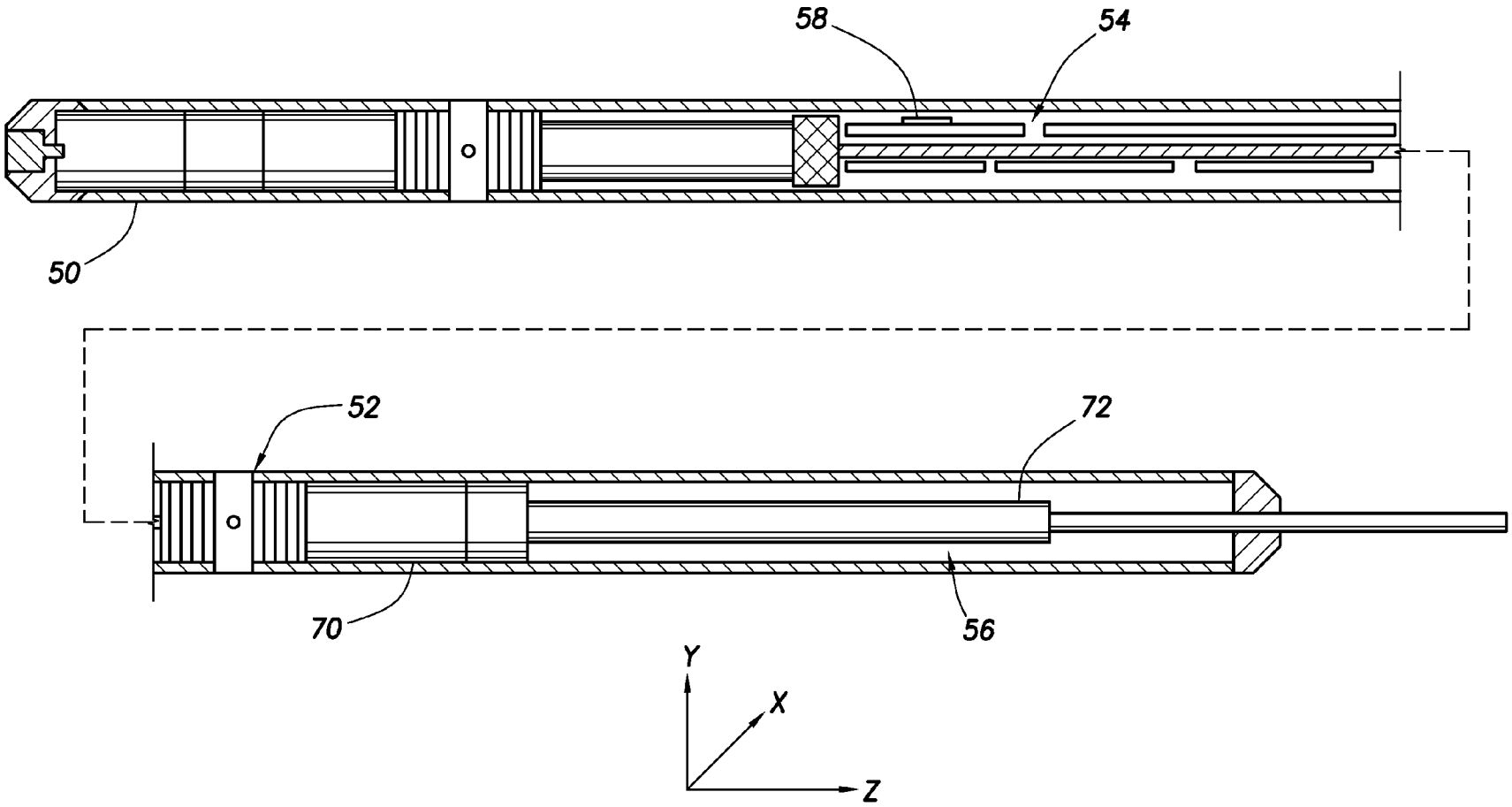
FIG. 4 is a schematic cross-sectional view of a setting tool which embodies principles of this disclosure, and which may be used in the system and method of FIG. 1, the tool string of FIG. 2, and/or the method of FIG. 3.

Referring additionally now to FIG. 4, an enlarged scale schematic cross-sectional view of the setting tool 52 is representatively illustrated. In this view it may be seen that the orientation indicator 54 is positioned in an electronic instrument section of the setting tool 52. Preferably, the orientation indicator 54 includes at least one accelerometer 58, and most preferably the accelerometer comprises a three-axis accelerometer.

A setting mechanism 56 is positioned below the instrument section of the setting tool 52. In this example, the setting mechanism 56 includes a motor 70 and a telescoping threaded assembly 72 for applying a setting force to a well tool (such as the well tool 20 described above), in order to set the well tool.

In some examples, three-axis or two-axis accelerometers 58 may be used to indicate azimuthal orientation of a well tool relative to a high side of a wellbore (an azimuthal orientation known to those skilled in the art as "relative bearing" or "tool face angle") and the angle between the wellbore and a true vertical line (or "gravity vector"). This latter angle is known as "hole inclination" or "hole deviation".

A three-axis (XYZ) or a two-axis (XZ) accelerometer 58 is mounted in the tool 52. The Z-axis is preferably mounted to coincide with the tool longitudinal axis. The XY plane is the plane perpendicular to the Z-axis. Either one of the XY accelerometers is mounted aligned with a well tool feature (such as the alignment device 24) that provides an angular reference (origin) in the XY plane.

The tool face is measured as the angular displacement between the position of a tool's XY reference feature and the high side of the wellbore. In the system 10 of FIG. 1, a key on the setting tool 52 which engages the alignment device 24 on the anchor 22 could, thus, be aligned with the Y-axis accelerometer of the orientation indicator 54. The X-axis accelerometer could be aligned 90 degrees clockwise from the Y-axis accelerometer, looking downhole (more technically expressed, this builds a right screw coordinate system).

When the setting tool 52 is horizontal and the key points directly upward, the Z-axis accelerometer and the X-axis accelerometer should measure zero and the Y-axis accelerometer should measure Ymax, which should correspond to G (gravity force). If the setting tool key points directly downward, then the Y-axis accelerometer should read Ymin. Using these positions the accelerometer Y is calibrated to read G, usually by a linear relationship.

The X-axis accelerometer is calibrated similarly, with the tool horizontal and the X-axis accelerometer pointing up for Xmax and pointing down for Xmin. If a Z-axis accelerometer is present, it is calibrated to read G when the tool is vertical and zero when the tool is horizontal.

Because G is practically the same in a considerably large geographical area, a calibrated two-axis XY-mounted accelerometer 58 can be used to measure both hole inclination and relative bearing, in wellbores deviated less than 90 degrees.

The equations used for measuring hole inclination are:

For a three-axis accelerometer, hole inclination=arccos (Z-axis acceleration/G). The sign of the Z-axis acceleration measurement determines if 90 degrees must be added to the inclination angle obtained above.

For a two-axis accelerometer, hole inclination=arcsin ((X-axis acceleration$^2$+Y-axis acceleration$^2$)$^{1/2}$/G).

For the relative bearing, the formula (for both three- and two-axis accelerometer packages) is: relative bearing=arctan 2 (X-axis acceleration/Y-axis acceleration). Arctan 2 is the 4-quadrant inverse tangent function.

All of the equations above may have variations as trigonometric relations normally allow several equivalent expressions.

All equations used for two-axis accelerometers can also be used for three-axis accelerometers.

It will now be readily appreciated that the system 10 and associated methods described above provide many advancements to the art of constructing setting tools and setting well tools in wellbores. In the method 60 described above, only a single trip into the wellbore 16 is needed to set the anchor 22 and provide an indication of the anchor's azimuthal orientation relative to the wellbore 16.

Specifically, the above disclosure provides to the art a setting tool 52 for setting a well tool 20 in a wellbore 16. The setting tool 52 includes a setting mechanism 56 which is operative to apply a setting force to set the well tool 20, and an orientation indicator 54 which indicates an orientation of the setting tool 52.

The orientation indicator 54 may indicate the orientation of the setting tool 52 when the well tool 20 is being set.

The orientation indicator 54 may indicate at least an azimuthal orientation of the setting tool 52.

The orientation indicator 54 may indicate at least an azimuthal orientation of the setting tool 52 relative to a low side of the wellbore 16.

The orientation indicator 54 may include at least one accelerometer 58.

The orientation indicator 54 may include a three-axis accelerometer 58.

Also described by the above disclosure is a method of setting a well tool 20 and engaging an assembly 26 with the well tool 20. The method includes setting the well tool 20 in a wellbore 16 utilizing a setting tool 52 which includes an orientation indicator 54; and then engaging the assembly 26 with the well tool 20, thereby fixing an orientation of the assembly 26 relative to the well tool 20.

Setting the well tool 20 may include applying a setting force from the setting tool 52 to the well tool 20.

The orientation indicator 54 may indicate an azimuthal orientation of the well tool 20 relative to the wellbore 16.

The orientation indicator 54 may indicate an orientation of the well tool 20 relative to the wellbore 16 during setting of the well tool 20 in the wellbore 16.

The method may include azimuthally orienting an alignment device 28 of the assembly 26 based on an orientation indication provided by the orientation indicator 54.

Fixing an orientation of the assembly 26 relative to the well tool 20 may include engaging the alignment device 28 with the well tool 20.

The above disclosure also describes a method 60 of azimuthally orienting a whipstock 30 in a wellbore 16. The method 60 includes setting an anchor 22 in the wellbore 16, with the anchor 22 including an alignment device 24; indicating an azimuthal orientation of the alignment device 24 relative to the wellbore 16; and the anchor 22 setting and azimuthal orientation indicating being performed using only a single trip into the wellbore 16.

The method 60 may also include engaging an alignment device 28 of the whipstock 30 with the alignment device 24 of the anchor 22, thereby fixing the azimuthal orientation of the whipstock 30 relative to the wellbore 16.

The method 60 may include azimuthally orienting the whipstock alignment device 28 relative to a deflection face 32 of the whipstock 30 prior to engaging the whipstock alignment device 28 with the anchor alignment device 24.

Azimuthally orienting the whipstock alignment device 28 may be performed based on the indication of the azimuthal orientation of the anchor alignment device 24 relative to the wellbore 16.

Setting the anchor 22 in the wellbore 16 may be performed using a setting tool 52 which includes an orientation indicator 54.

The orientation indicator 54 may include at least one accelerometer 58.

The orientation indicator 54 may include a three-axis accelerometer 58.

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

In the above description of the representative embodiments of the disclosure, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A setting tool for setting a well tool in a wellbore, the setting tool comprising:

a setting mechanism which applies a setting force to set the well tool; and an orientation indicator which is connected to the setting mechanism and which indicates an orientation of the setting tool.

2. The setting tool of claim 1, wherein the orientation indicator indicates the orientation of the setting tool when the well tool is being set.

3. The setting tool of claim 1, wherein the orientation indicator indicates at least an azimuthal orientation of the setting tool.

4. The setting tool of claim 1, wherein the orientation indicator indicates at least an azimuthal orientation of the setting tool relative to a low side of the wellbore.

5. The setting tool of claim 1, wherein the orientation indicator comprises at least one accelerometer.

6. The setting tool of claim 1, wherein the orientation indicator comprises a three-axis accelerometer.

7. A method of setting a well tool and engaging an assembly with the well tool, the method comprising:

setting the well tool in a wellbore utilizing a setting mechanism and an orientation indicator which is connected to the setting mechanism; and then engaging the assembly with the well tool, thereby fixing an orientation of the assembly relative to the well tool.

8. The method of claim 7, wherein setting the well tool further comprises applying a setting force from the setting mechanism to the well tool.

9. The method of claim 7, wherein the orientation indicator indicates an azimuthal orientation of the well tool relative to the wellbore.

10. The method of claim 7, wherein the orientation indicator indicates an orientation of the well tool relative to the wellbore during setting of the well tool in the wellbore.

11. The method of claim 7, further comprising azimuthally orienting an alignment device of the assembly based on an orientation indication provided by the orientation indicator.

12. The method of claim 11, wherein fixing an orientation of the assembly relative to the well tool comprises engaging the alignment device with the well tool.

13. A method of azimuthally orienting a whipstock in a wellbore, the method comprising:

setting an anchor in the wellbore, the anchor including an alignment device;

indicating an azimuthal orientation of the alignment device relative to the wellbore; and the anchor setting and azimuthal orientation indicating being performed in the wellbore using only a single trip into the wellbore.

14. The method of claim 13, further comprising engaging an alignment device of the whipstock with the alignment device of the anchor, thereby fixing the azimuthal orientation of the whipstock relative to the wellbore.

15. The method of claim 14, further comprising azimuthally orienting the whipstock alignment device relative to a deflection face of the whipstock prior to engaging the whipstock alignment device with the anchor alignment device.

16. The method of claim 15, wherein azimuthally orienting the whipstock alignment device is performed based on the indicating the azimuthal orientation of the anchor alignment device relative to the wellbore.

17. The method of claim 13, wherein setting the anchor in the wellbore is performed using a setting tool comprising an orientation indicator.

18. The method of claim 17, wherein the orientation indicator comprises at least one accelerometer.

19. The method of claim 17, wherein the orientation indicator comprises a three-axis accelerometer.

* * * * *